US007566144B2

(12) United States Patent
McDermott

(10) Patent No.: US 7,566,144 B2
(45) Date of Patent: Jul. 28, 2009

(54) BROAD BEAM LIGHT

(76) Inventor: Kevin McDermott, 110 Oyster Pl., Rockledge, FL (US) 32955

( * ) Notice: Subject to any disclaimer, the term of this patent is extended or adjusted under 35 U.S.C. 154(b) by 0 days.

(21) Appl. No.: 11/591,394

(22) Filed: Nov. 1, 2006

(65) Prior Publication Data

US 2009/0016069 A1 Jan. 15, 2009

(51) Int. Cl.
*F21V 5/00* (2006.01)

(52) U.S. Cl. ..... 362/244; 362/235

(58) Field of Classification Search ..... 362/216, 362/235, 238, 240, 244, 249, 326, 335, 246, 362/336–340, 800
See application file for complete search history.

(56) References Cited

U.S. PATENT DOCUMENTS

| | | | | |
|---|---|---|---|---|
| 3,344,264 | A * | 9/1967 | Perkins | 362/237 |
| 5,224,773 | A | 7/1993 | Arimura | |
| 5,309,277 | A * | 5/1994 | Deck | 359/387 |
| 5,899,557 | A | 5/1999 | McDermott | |
| 6,048,083 | A * | 4/2000 | McDermott | 362/337 |
| 6,799,864 | B2 * | 10/2004 | Bohler et al. | 362/236 |
| 6,808,290 | B2 * | 10/2004 | Lee | 362/202 |
| 6,905,228 | B1 * | 6/2005 | Takeyasu et al. | 362/237 |
| 7,186,000 | B2 * | 3/2007 | Lebens et al. | 362/184 |
| 7,416,312 | B1 * | 8/2008 | McDermott | 362/216 |
| 2005/0146875 | A1 * | 7/2005 | Klein | 362/253 |

* cited by examiner

*Primary Examiner*—Bao Q Truong

(57) ABSTRACT

A high efficiency, broad beam lighting device 30 having a converging lens 1 having a curved focal line 26. A source of light comprising a plurality 9 of ceramic LED lamps disposed in an equiangular array having their apparent emission line between minimum divergence curved line 37 and interior surface 27 of converging lens 1 on broad beam curved line 39 such that each LED has its emitted light concentrated by lens 1 into an elongated light beam comprising a central zone substantially surrounded by a peripheral zone. Converging lens 1 further concentrates the light emitted by plurality 9 of LED lamps into a composite elongated light beam having a broad vertical beam spread and concurrently increasing the intensity at the location of the central zone of the elongated light beam of each LED by adding to that central zone location light from the elongated light beam of at least one adjacent LED.

25 Claims, 7 Drawing Sheets

BROAD BEAM LIGHT

BACKGROUND OF THE INVENTION

1. Field of Invention

This invention relates to a high efficiency, broad beam lighting device which employs as a light source a plurality of LED lamps disposed within a hollow of a converging lens. Each LED lamp emitting light concentrated by the converging lens to form an elongated light beam whereby the elongated light beams overlap such that the light at a central zone of one elongated light beam is bolstered by light extending into that central zone from an adjacent elongated light beam to form a composite elongated light beam having a specification azimuth and specification broad vertical beam spread.

2. Prior Art

Prior art developed designs which either maximized the intensity directly in front of each LED lamps of a plurality of LED lamps in the horizontal direction or minimized the divergence of the composite light beam about the horizontal. These two objectives are very similar but due to the fact that the converging lens is formed about a curved focal line in place of a focal point they are not always exactly the same. Although prior art designs sought to minimize the divergence of the emitted light about the horizontal, the final product would always have some small or minimal divergence or vertical beam spread due to the size of the light source, lens, contour, tolerances, etc. A primary component of prior art designs included locating the LED element exactly on or just slightly in front of the focal circle towards the lens. In the current invention the LED element is disposed closer to the lens than prior art in order to broaden the beam spread and increase the efficiency.

There are a variety of specifications which could apply to the lighting device of the current invention. Typically, one of these specifications would require a peak intensity at the center of the light beam and define the vertical beam angle as the angle between the vertical angular deviations from the center at which the peak intensity decreases to a percentage of the peak intensity. The decrease in intensity can have a number of values normally ranging from fifty to ninety percent. A similar technique is employed to establish the horizontal beam angle or beam spread. Other specifications do not require a central peak intensity but define the vertical and horizontal beam angles at the respective angular deviations from the center at which the intensity falls below a minimum value. A lighting device which emits a light beam having a central zone of depressed intensity is usually not desirable for many applications. In addition it can easily fail to meet specifications that require a centrally located peak intensity.

Some specifications require that the output beam comprise minimizing the vertical divergence exactly as designed by prior art. However, other specifications establish intensity requirements within a broad vertical beam spread throughout an azimuth. These other specifications are the subject of the current invention which increases the efficiency of lighting devices required to comply with specifications requiring light distributed within a broad vertical beam spread. The increase in efficiency in the current invention results from changes in the construction of the lighting device which would not be acceptable when the lighting device was required to meet the prior art objective of minimizing the vertical beam spread. Changes in construction between prior art and the current invention include changing from a relatively large to a relatively small focal length, changing the disposition of the apparent point of emission of each LED, employing flat ceramic LEDs devoid of lenses and mounting the ceramic LED lamps on the peripheral edge of the printed circuit board. Specifically, regarding the disposition of the LEDs, each LED is disposed with its point of emission closer to the lens than prior art. This current application LED placement always increases the divergence of the emitted light beam about the horizontal plane relative to the minimal divergence desired by a prior art and usually—but not always—creates a projected light beam having a central zone of low intensity relative to a surrounding peripheral zone. This change in the prior art design results in an emerging beam pattern of light concentrated by lens 1 emitted by each LED which would appear to be problematic for many applications. However, it is especially problematic for specifications which require a peak intensity at the center of the projected beam.

Prior art designs, as well as the current invention, include the goal of having a composite light beam which is uniform throughout a required azimuth. This objective is universal because lighting devices which emit non-uniform light beams require excessive power. Excessive power is consumed because the overall intensity of the emitted beam must be increased in order for all zones of the light beam to meet the minimum intensity requirements. Therefore, changes in prior art designs which could encourage azimuthal variations in the intensity of the emerging beam would normally be considered as problematic. Conversely, changes in prior art which would improve the azimuthal uniformity of the emerging light beam would be beneficial. Adding more LED lamps to a light of limited size would be beneficial. It is noteworthy to realize that the problem of maintaining a uniform intensity for each angle of a vertical beam spread throughout an azimuth intensifies as the vertical beam spread is increased from minimum to broad.

Typical prior art for a lighting device emitting light having a large azimuthal and small vertical beam spread can be found in U.S. Pat. No. 5,224,733 issued to Arimura in which a circular array of a large number of LED lamps direct their light into a linear fresnel lens to create a horizontal light beam throughout the azimuth. Arimura in Column 5, Lines 49-55 describes a focal circle having a one-inch diameter and eighty LEDs arranged in an array. This array is encircled by a thin linear fresnel lens. The use of LED lamps with optics tends to create dark zones in the output beam between LED lamps. The large quantity of LED lamps in his array helps to mitigate the potential problem of dark zones within the output beam between LED lamps.

Prior art implies using a large focal length relative to the size or outside diameter of the lens. Prior art additionally discloses problems relating to the shape of the LED lamp that is used. In McDermott U.S. Pat. No. 5,899,557 Column 10, Lines 57-59, he discloses the objective of increasing distance D2. This is equivalent to increasing the focal length. In his abstract, McDermott disclosed employing a plurality of LED lamps encircled by a curved cylindrical surface to concentrate the emitted light into a composite beam with the intensity of the projected beam maximized. McDermott in the referenced patent did not require the lens hollow employed in the current invention. In Column 12, Lines 7-15 McDermott disclosed moving his LED element relative to the focal point to change the vertical beam spread. This disclosed movement and its result was based upon analysis of a lens devoid of a hollow. The optics change with the addition of a hollow. McDermott did not reveal the central zone of reduced intensity that would result if the movement of the LED towards the lens of that patent continued or what significance that central depressed intensity zone would have.

In a second U.S. Pat. No. 6,048,083 also issued to McDermott, he employs classical lenses having a hollow to concentrate the light from his array of LED lamps. In this patent, McDermott places the apparent focal point of his LED lamps between the bent focal line and the interior wall of the lens in order to maximize the efficiency when concentrating light towards the horizontal to achieve minimal divergence. In Column 5, Lines 23-25 McDermott locates each LED element a slight distance on the lens side of the focal point. In Column 14, Lines 57-60 McDermott states his objective "to minimize divergence of light from said respective light emitting diode element about said horizontal plane". Although not used in his prior art patent, in the current invention the term "minimum divergence curved line" is used to describe the location of the apparent points of emission of the LEDs in the McDermott prior art patent. This term simplifies the discussion in the current specification.

In addition, McDermott in FIG. 10, Column 13, Lines 34-66 discloses an apparent focal point problem with the T1 ¾ LED lens top lamps that can cause the lighting device to squander light. Specifically, the body of the T1 ¾ LED normally has a lens that refracts emitted light. This refraction creates a plurality of apparent focal points which causes the LED to appear to the lens as an enlarged light source. McDermott offers a spherical top LED as a preferred way to alleviate this problem. The spherical LED, theoretically, does not refract light emitted from the LED element and therefore, theoretically, does not cause the small LED emitter to appear large. This concept does minimize enlargement of the LED source but—due to manufacturing variations in the spherical contour and placement of the LED element—does not totally eliminate it. Nevertheless, this type of problem is one reason that prior art places its LED arrays at a substantial focal distance (visually observed from the figures provided in the referenced prior art) from the lens. If as indicated in the referenced prior art the objective is to minimize the divergence of the composite emitted light beam about the horizontal, then a small or minimum vertical beam spread is the goal. In order to maximize the light directed into a small vertical beam spread prior art designed to maximize control of the light. This was necessary as a slight misdirection would cause the light to miss its small target of a small vertical beam spread. In general, in order to control the light more effectively, it is desirable to have both a lens with a large focal distance combined with a very small or a point light source. The large focal distance indicated by prior art reduces misdirected light resulting from variations in light source placement or lens contour. It also reduces the negative consequences of enlargement of the light source related to shifting of the apparent point of emission. Since no light source is as small as a point source and since even small light sources can have apparent size enlargements due to refraction at their lens or body, it is usually desirable to have a large focal length to offset these problems. Unfortunately, the large focal length indicated by referenced prior art when combined with the plurality of LED emitters employed to assure an azimuthally uniform beam work against designing a lighting device which is compact, efficient and emitting light having a broad beam spread.

Finally, LED lamps with spherical domes can—due to their close disposition—have domes which intersect and divert diverging lights from adjacent LED lamps. A large focal length mitigates this problem.

Prior art encouraged a relatively large focal length because a large focal length—as previously described—solved many problems. A small focal length also had advantages which would have been known to prior art designers such as a reduction in both the mass of the converging lens and the ability to add additional LED lamps to a lighting device of limited size. However, when prior art considered the issue, the large focal length was the best choice. Two factors that were included when making that decision. The first was overcoming possible enlargement of the apparent point of emission resulting from the limited number of commercially available LED packages both bright enough to meet intensity requirements and devoid of domes or lenses. The second was the desire to have an emerging light beam of minimal divergence about the horizontal. In general, a shortened focal length will always increase the percentage of light that is misdirected because the LED placement varies and the LED element is not a point source. However, as the permissible vertical beam spread of the composite elongated light beam is broadened, the loss in efficiency due to a reduced focal length is reduced. The above factors in addition to the reduced mass of the lens resulting from a reduced focal length make it the preferred choice.

The current invention employs a short focal length to create a lighting device of improved efficiency and reduced size.

The referenced prior art teaches or at least implies the following concepts which are not taught in the current invention:

- having a lens which defines a focal distance which is substantial in magnitude relative to the radius of the lens.
- positioning the LED lamps at the focal point or at a slight distance from the focal point towards the lens on the minimum divergence curved line to minimize the horizontal divergence of the light as it emerges from the lens.
- having a lighting device designed to minimize divergence of the light about the horizontal.

The referenced prior art teaches the following concepts which are also employed in parts of the current invention:

- a curved cylindrical surface or a fresnel lens which is formed to provide a curved focal line, bent focal line or a plurality of focal points to provide an emerging elongated light beam.
- a curved array of LED lamps with each lamp having its apparent point of emission between its related focal point and the lens (see McDermott U.S. Pat. No. 6,048,083 Column 5, Lines 22-26). The current application disposes the apparent points of emission even closer to the lens.

3. Objects and Advantages

The objects and advantages of the present invention are to create a high efficiency lighting device employing a converging lens to concentrate light from a plurality of LED lamps into an elongated composite light beam having a broad vertical beam spread and a uniform intensity throughout an azimuth.

- to provide an LED lighting device which minimizes the operating temperature of its LED lamps to thereby increase their efficiency resulting in increased efficiency for the entire lighting device;
- to maximize the percentage light energy emitted by a plurality of LED lamps which is concentrated into a specification broad vertical beam spread throughout a specified azimuth.

In the current invention ceramic LED lamps are acceptably powerful and because they are devoid of a dome or lens they virtually eliminate enlargement and shifting of the apparent point of emission. Also, in the current invention the emerging light is no longer required to be concentrated with minimal divergence about the horizontal. In practice, many specifications do not require the light to be concentrated with minimal divergence about a plane but instead require the light to be concentrated within a broad vertical beam spread typically from four to fifty degrees. The elimination of the apparent shifting of the point of emission and the broad beam spread specifications individually and in combination make lighting devices constructed with a small focal length and the LED disposition further from the focal point and closer to the lens in accord with the current invention a superior design.

The referenced prior art does not teach or address the following concepts which are employed in the current invention:

- employing the concepts of a small focal length, peripherally mounted LED lamps and placement of the apparent points of emission of each LED between the minimum divergence curved line and the lens to provide a compact and efficient lighting device capable of emitting a powerful elongated light beam having a broad vertical beam spread.
- Maximizing the intensity and uniformity of an elongated light beam having a broad vertical beam spread from a lighting device of limited size by reducing the focal length of the converging cylindrical lens.
- Increasing the quantity of LED lamps deployable within a lighting device of limited size by reducing the focal length thereby providing a larger diameter for the array of LED lamps resulting in increased uniformity in the emerging elongated light beam.
- Disclosing the concept that the focal length can be reduced and efficiency increased for specifications which mandate broad vertical beam spreads.
- Shaping the lens and positioning the plurality of LED lamps so that a central depressed intensity zone created by one LED is buttressed with light from at least one but possibly several adjacent LEDs.
- Using ceramic LED lamps without lenses to virtually eliminate dome or lens related shifting of the point of light emission.
- Employing a plurality of ceramic LED lamps each of which comprise a ceramic body capable of withstanding high heat attached to the peripheral edge of a printed circuit board to disperse that heat.
- Soldering ceramic LED lamps devoid of wire leads to the peripheral edge of the printed circuit board to provide room on the top and the bottom surface of the printed circuit board for other components.
- Improving the efficiency of lighting devices requiring a broad vertical or transverse beam spread by having separately or in combination: a lens with a short focal length, LED lamps positioned further from the focal point than the slight distance from the focal point disclosed by prior art (see McDermott U.S. Pat. No. 6,048,083 Column 5, Lines 22-26) and employing ceramic LED lamps devoid of a lens.
- reducing the focal length to broaden the vertical beam spread of the elongation zone to assure it completely overlaps the adjacent central zone.

Further objects and advantages are realized through combinations of the above distinct advantages.

SUMMARY

In accordance with the present invention a lighting device comprising a converging lens for concentrating light into a composite elongated light beam; said lens having a hollow and curved contour formed about a curved line; a light source comprising a plurality of LED lamps positioned within said hollow with their apparent emission line disposed between a minimum divergence curved line of said lens and said lens to direct emitted light radially outward to intersect said converging lens; said plurality of LED lamps each emitting a light concentrated by said lens into an elongated light beam having a central zone; each said elongated light beam overlapping an adjacent central zone of at least one adjacent LED lamp to increase the intensity of that adjacent central zone.

DRAWINGS

Figures

FIG. 1 is a perspective view of the preferred embodiment of lighting device 30 of the current invention FIG. 2 is a front view of FIG. 1

FIG. 3 is an enlarged cross-section taken along line 3-3 of FIG. 2

FIG. 4 is an enlarged cross-section taken along line 4-4 of FIG. 3

FIG. 5 is an enlarged view of printed circuit board assembly 2 removed from FIG. 4

FIG. 6 is a perspective view of typical red LED R1 removed from FIG. 4

FIG. 7 is a rear view of red LED R1 of FIG. 6

FIG. 8 is a schematic 16 of the circuit configured on the printed circuit board of FIG. 5

FIG. 9 is a view of lens 1 removed from FIG. 3

FIG. 10 is a view of lens 1 removed from FIG. 4

FIG. 11 is an enlarged view of the portion of FIG. 3 around red LED R1

FIG. 12 is an enlarged view of the portion of FIG. 4 around red LED R1

FIG. 13 is a diagrammatic view of a typical light beam projection from red LED R1 of lighting device 30

FIG. 14 is a diagrammatic view of light beam projections from adjacent red LEDs R1, R2 and R40 of lighting device 30

FIG. 15 is a front view of lighting device 34 an alternate configuration of FIG. 1 lighting device 30 employing a fresnel lens FIG. 16 is a cross sectional view taken across line 16-16 of FIG. 15

FIG. 17 is an enlarged diagrammatic view of a prior art LED lamp

DRAWINGS

Reference Letters

| | |
|---|---|
| A1 | Vertical Included Angle |
| A2 | Horizontal Included Angle |
| C1 | Resistor |
| D1 | Back Focal Length |
| D2 | Vertical Distance |
| D3 | Horizontal Distance |
| F1 | Focal Point |
| H | Horizontal Plane |
| L1 | Upper Vertical Light Ray |
| L2 | Lower Vertical Light Ray |
| L3 | Left Horizontal Light Ray |
| L4 | Right Horizontal Light Ray |
| L5 | Left Horizontal R2 Light Ray |
| P1 | Upper Intersection Point |
| P2 | Lower Intersection Point |
| P3 | Left Intersection Point |
| P4 | Right Intersection Point |
| P5 | R2 Intersection Point |
| R1 thru R40 | Red LED Lamps 1 thru 40 |
| R1B | Light Beam Projection from Red LED R1 |
| R2B | Light Beam Projection from Red LED R2 |

-continued

| | |
|---|---|
| R40B | Light Beam Projection from Red LED R40 |
| R1C | Central Zone of R1B |
| R2C | Central Zone of R2B |
| R40C | Central Zone of R40B |
| R1LP | Lower Peripheral Zone of R1P |
| R2LP | Lower Peripheral Zone of R2P |
| R40LP | Lower Peripheral Zone of R40P |
| R1L | Left Elongation Zone of R1B |
| R1R | Right Elongation Zone of R1B |
| R2L | Left Elongation Zone of R2B |
| R2R | Right Elongation Zone of R2B |
| R40L | Left Elongation Zone of R40B |
| R40R | Right Elongation Zone of R40B |
| R1P | Peripheral Zone of R1B |
| R2P | Peripheral Zone of R2B |
| R40P | Peripheral Zone of R40B |
| R1UP | Upper Peripheral Zone of R1P |
| R2UP | Upper Peripheral Zone of R2P |
| R40UP | Upper Peripheral Zone of R40P |
| V | Vertical Plane |
| CLB | Composite Elongated Light Beam |
| R1CA | Adjacent Central Zone |
| R1CD | Depressed Intensity |
| R1CIB | Central Intensity of Central Zone R1C Buttressed |
| R1BB | Elongated Light Beam From Red LED Lamp R1 |
| R1CI | Central Intensity of Central Zone R1C |
| R1PI | Peripheral Intensity of Peripheral Zone R1P |
| R2BB | Elongated Light Beam From Red LED Lamp R2 |
| R40BB | Elongated Light Beam From Red LED Lamp R40 |

DRAWINGS

Reference Numerals

| | | | |
|---|---|---|---|
| 1 | converging lens | 2 | printed circuit board assembly |
| 3 | screw | 4 | hole |
| 5 | printed circuit board | 6 | switch |
| 7 | power supply | 8 | tracks |
| 9 | plurality | 10 | |
| 11 | hollow | 12 | negative solder pad |
| 13 | positive solder pad | 14 | ceramic body |
| 15 | light emitting element | 16 | schematic |
| 17 | lens hole | 18 | peripheral bottom |
| 19 | peripheral top | 20 | peripheral edge |
| 21 | knob | 22 | contact arm |
| 23 | lens hole | 24 | focal circle |
| 25 | focal points | 26 | curved focal line |
| 27 | interior surface | 28 | curved exterior surface |
| 29 | plano convex form | 30 | lighting device |
| 31 | center point | 32 | minimum divergence point |
| 33 | apparent emission line | 34 | lighting device |
| 35 | fresnel lens | 36 | printed circuit board assembly |
| 37 | minimum divergence curved line | 38 | broad beam point |
| 39 | broad beam curved line | 40 | lamp |
| 41 | body | 42 | axis |
| 43 | element | 44 | lens |
| 45 | light ray | 46 | point of intersection |
| 47 | angle | 48 | normal |
| 49 | angle | 50 | apparent point of emission |
| 51 | distance | 52 | upper low intensity zone |

-continued

| | | | |
|---|---|---|---|
| 53 | coverging lens | 54 | lower low intensity zone |
| 55 | vertical beam spread | 56 | broad beam spread |
| 57 | second apparent point of emission | | |

DESCRIPTION OF THE DRAWINGS

FIG. 1 is a perspective view of lighting device 30. FIG. 2 is a front view of lighting device 30. FIG. 3 is a cross-section along lines 3-3 of FIG. 2. FIG. 4 is a stepped cross-section taken across line 4-4 of FIG. 3. FIG. 3 includes lens 1 and printed circuit board assembly 2 connected and fastened together with screw 3 inside of lens hollow 11. FIG. 5 shows printed circuit board assembly 2 removed from FIG. 4. Printed circuit board assembly 2 includes printed circuit board 5, power supply 7 and plurality 9 of rectangular ceramic LED lamps. Printed circuit board 5 comprises conductive tracks 8 and hole 4 for accepting screw 3.

FIGS. 6 and 7 are perspective and rear views of typical ceramic red LED R1, Model NFSR036CT made by Nichia Corp. Equivalent ceramic LED lamps are available from other manufacturers. Red LED R1 is typical of the forty LED lamps of plurality 9. Red LED R1 comprises negative solder pad 12, positive solder pad 13, ceramic body 14 and light emitting element 15.

FIG. 8 is a schematic 16 of the circuit on printed circuit board assembly 2 of FIG. 5. Printed circuit board 5 is manufactured with conducting tracks 8 and assembled using classical methods so that printed circuit board assembly 2 comprises circuit schematic 16 of FIG. 8. A large number of conductive tracks 8 are required to effect the required circuit. However, for simplicity of illustration, only several are drawn in FIG. 5. Power supply 7 is attached to printed circuit board 5 using a classical method such as solder tabs. In FIG. 5 plurality 9 is comprised of forty LED lamps having an equiangular spacing at nine degree intervals. Each LED of plurality 9 is soldered using its negative solder pad 12 and positive solder pad 13 to peripheral bottom 18, peripheral top 19 and peripheral edge 20 of printed circuit board 5 and along peripheral edge 20 by means of conducting tracks 8. Conducting tracks 8 extend onto peripheral edge 20 to facilitate soldering and increase the transfer of heat away from the plurality 9 of LED lamps. FIG. 9 is lens 1 removed from FIG. 3. FIG. 10 is lens 1 removed from FIG. 4. Looking at FIGS. 3, 4, 9 and 10 lens 1 is a classical light converging lens having interior surface 27 and curved exterior surface 28. In FIG. 9 lens 1 has a vertical cross-section which is a piano convex form 29 having focal point F1. Plano convex form 29 is rotated about center point 31 of lens 1 to effect a curved cylindrical contour about hollow 11. Lens 1 is thereby contoured to define a plurality of focal points 25 in horizontal plane H along the locus of which is a first curved line or curved focal line 26 all within hollow 11. In the present embodiment, curved focal line 26 is in horizontal plane H and is a focal circle 24.

Figure 1:
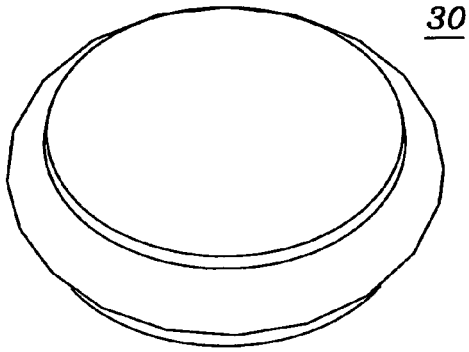
FIGS. 1 through 12 show the preferred embodiment of the present invention.
Figure 2:
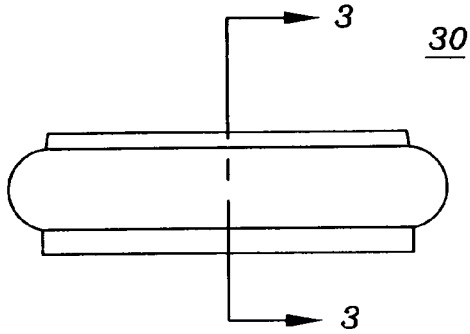

Each LED of plurality 9 of LED lamps is disposed about focal circle 24 in a circular radial array with its LED element directed radially outward from center point 31 of curved focal line 26 towards interior surface 27 of lens 1 to thereby direct its emitted light to intersect lens 1. Center point 31 is the center point of hollow 11 and lens 1.

Figure 3:
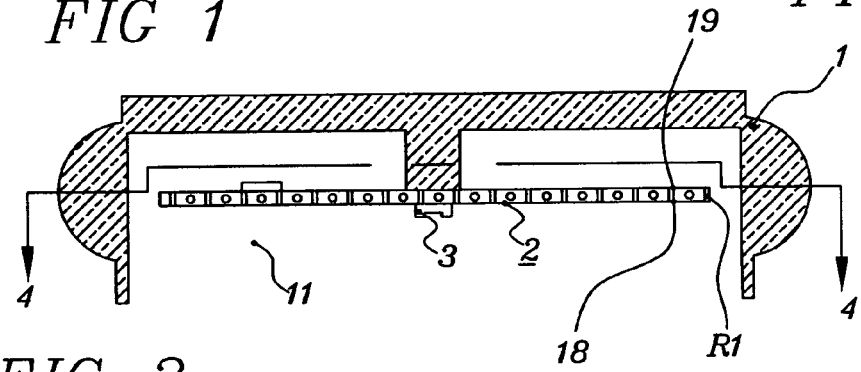
Figure 4:
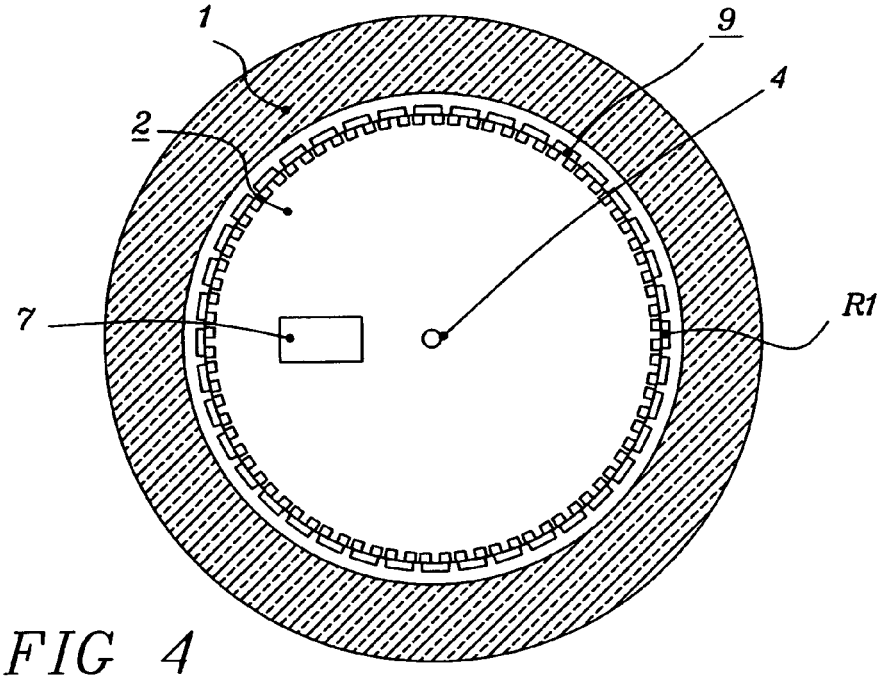
Figure 5:
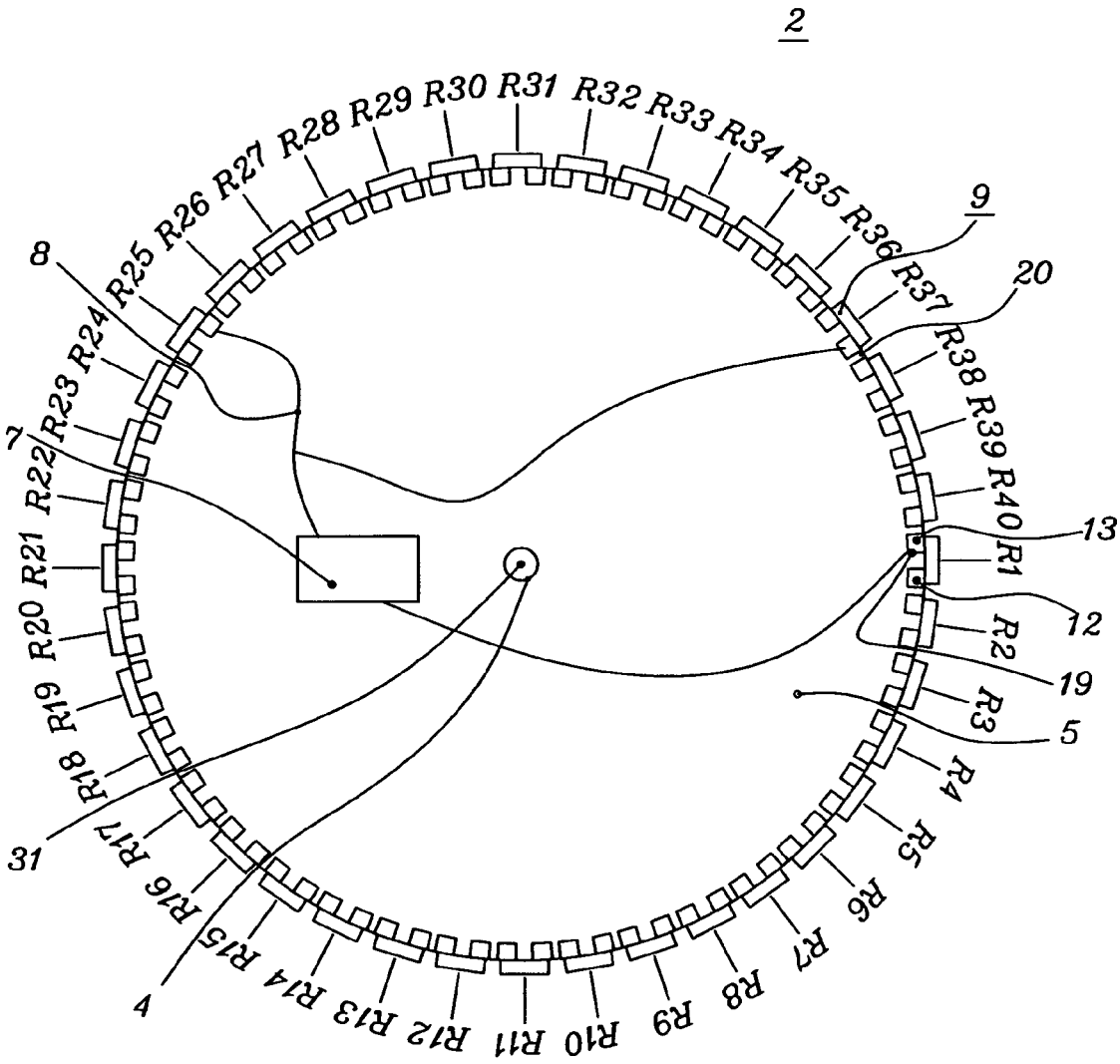
Figure 6:
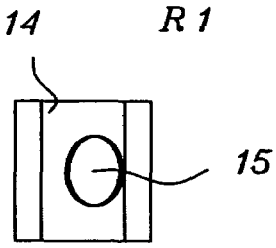
Figure 7:
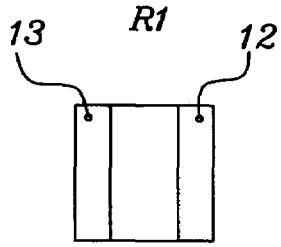
Figure 9:
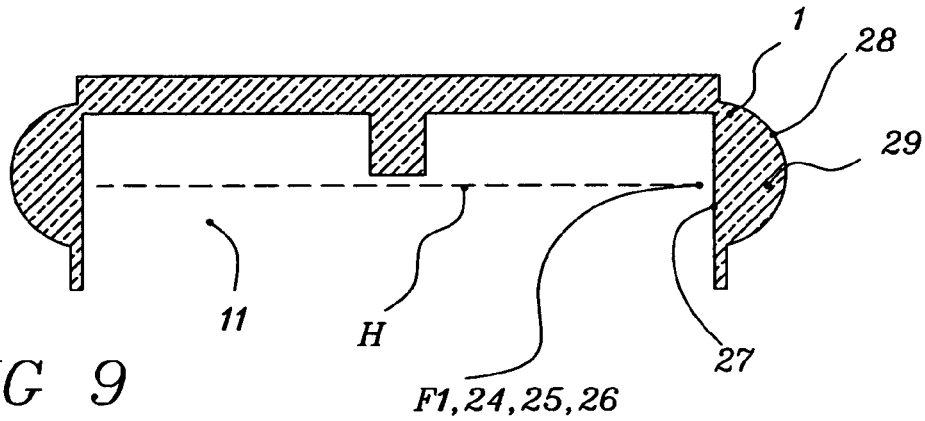
Figure 10:
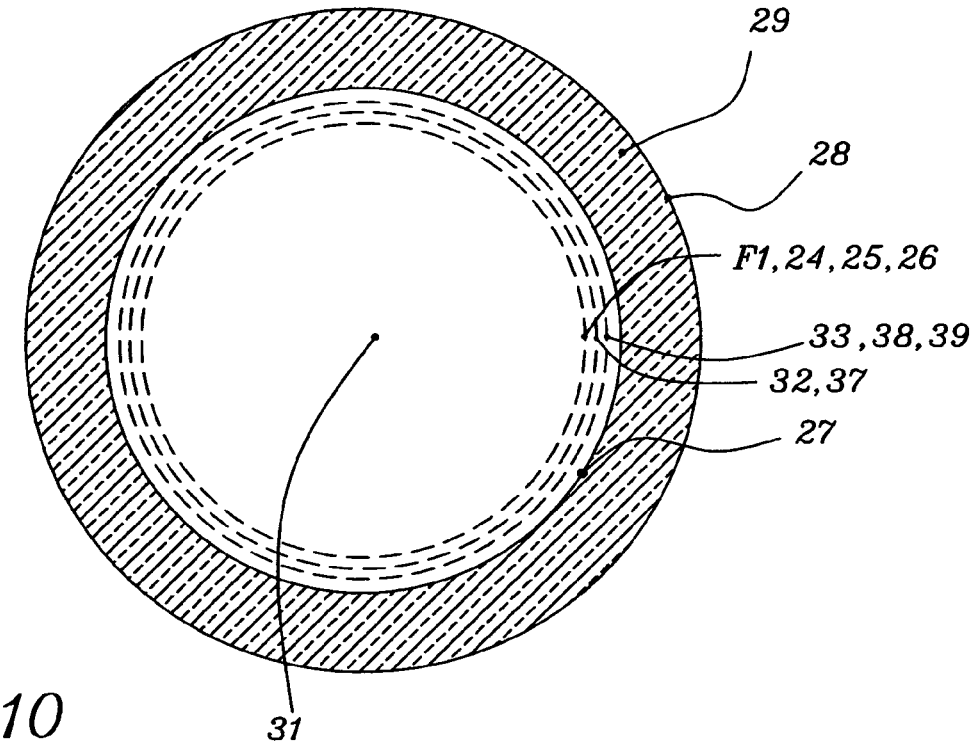
Figure 11:
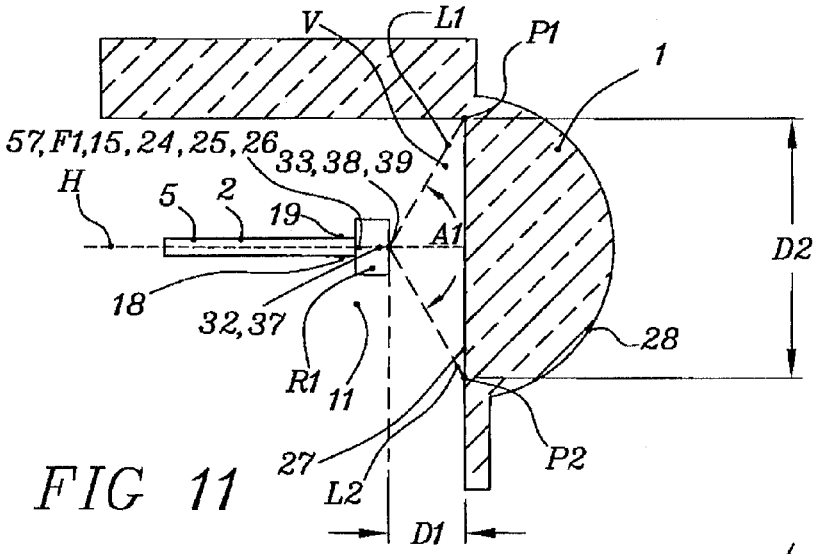
Figure 12:
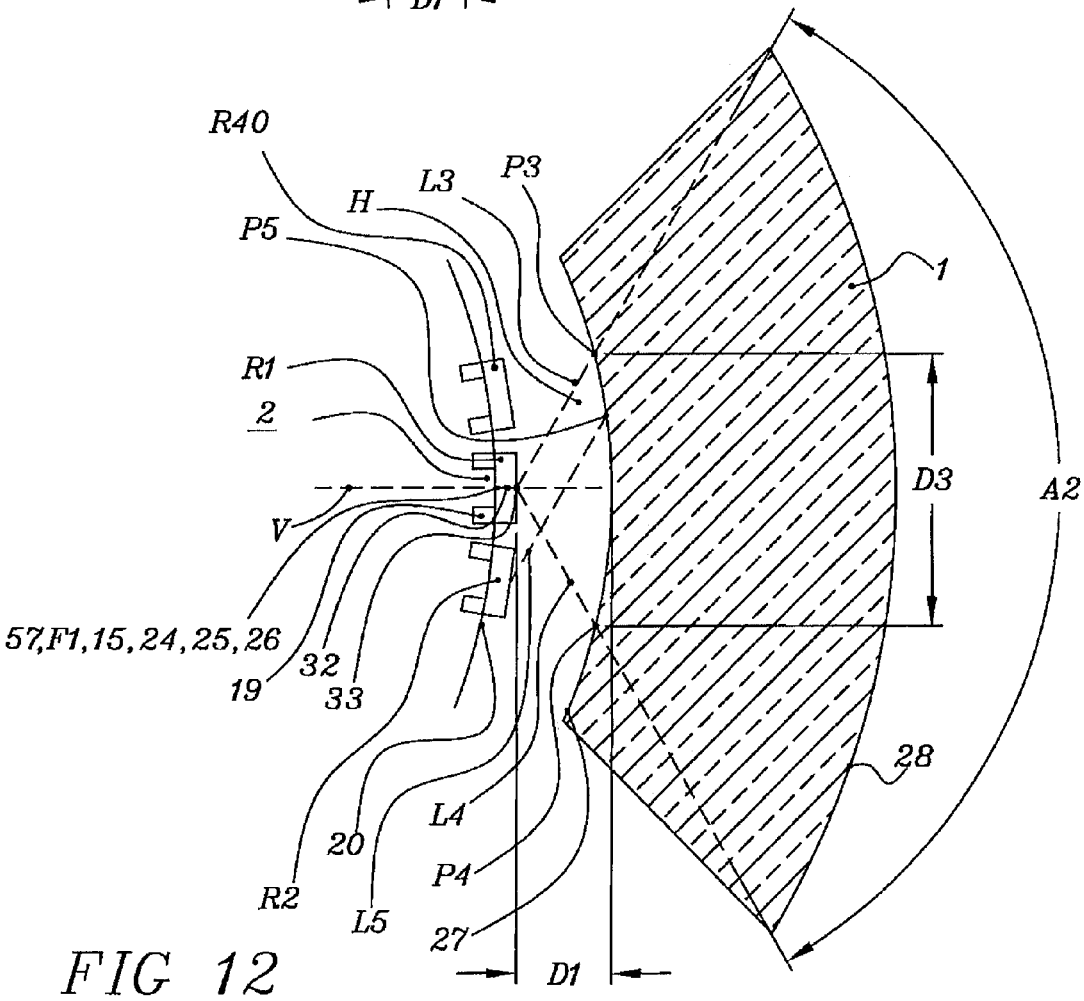

FIG. 11 is an enlarged diagrammatic view of the portion of FIG. 3 around red LED R1. FIG. 12 is an enlarged diagrammatic view of the portion of FIG. 4 around red LED R1. In FIGS. 9 and 11 back focal length D1 of lens 1 is five millimeters and represents the distance between interior surface 27 and broad beam point 38 of broad beam curved line 39 of lens 1 at red LED R1. Printed circuit board assembly 2 is disposed so that group 9 of LED lamps is positioned with the light emitting element of each of its forty LED lamps—typified by light emitting element 15 of red LED R1—on apparent emission line 33 coincident with broad beam curved line 39 with their emitted light directed radially outward from center point 31 at curved interior surface 27. Apparent emission line 33 is a curved line passing through the apparent point of emission for each LED lamp. In the present embodiment the LED lamps which are employed each have their apparent point of emission at their light emitting element. Apparent emission line 33 is between focal circle 24 and lens 1.

FIG. 11 shows red LED R1 emitting upper vertical light ray L1 in vertical plane V at 60 degrees above horizontal plane H and lower vertical light ray L2 at 60 degrees below horizontal plane H forming vertical included angle A1. Light rays L1 and L2 intersect curved interior surface 27 of lens 1 at upper point P1 and lower point P2 respectively which are separated by vertical distance D2. Vertical distance D2 represents the height of lens 1 required to intersect emitted light within vertical included angle A1. FIG. 12 is an enlarged diagrammatic view of the portion of FIG. 4 around red LED R1. FIG. 12 shows red LED R1 emitting left horizontal light ray L3 in horizontal plane H at 60 degrees to the left of vertical plane V and right horizontal light ray L4 in horizontal plane H at 60 degrees to the right of vertical plane V forming horizontal included angle A2 also of 120 degrees. Left horizontal light ray L1 and right horizontal light ray L4 intersect lens 1 at left intersection point P3 and right intersection point P4 respectively separated by horizontal distance D3. Left horizontal light ray L3 intersects interior surface 27 at left intersection point P3. Red LED R2 disposed alongside red LED R1 when energized emits a diverging light including left horizontal light ray L5 in horizontal plane H at sixty-degrees to the left of vertical plane V which intersects interior surface 27 at intersection point P5. Intersection point P5 is between left intersection point P3 and right intersection point P4. Therefore, red LED R2 and red LED R1 use a common portion of lens 1 to concentrate their emitted light. Some of the remaining LED lamps also can use the same common area of lens 1 depending upon a number of parameters including but not limited to the number of LED lamps in plurality 9 of LED lamps and focal distance F1. Minimum divergence point 32 and minimum divergence curved line 37 to be discussed later provide a possible prior art location for apparent emission line 33.

Figure 13:
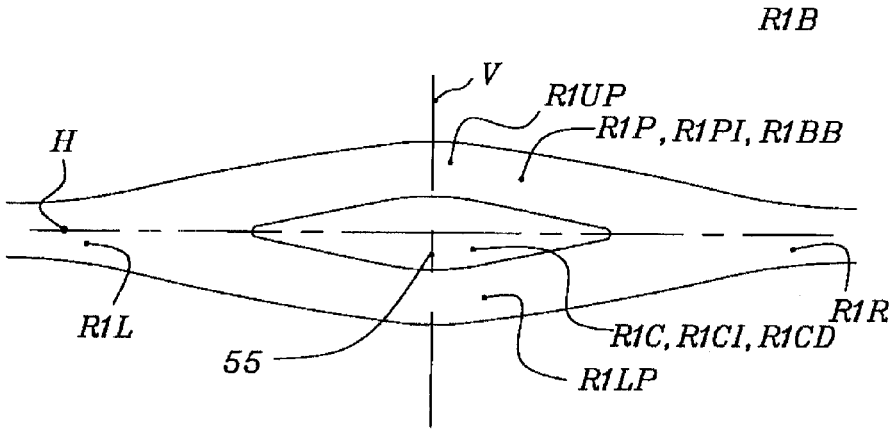

FIG. 13 is a diagrammatic view of a typical light beam projection R1B of elongated light beam R1BB which intersects vertical plane V at vertical beam spread 55 from red LED R1 after its light is concentrated by converging lens 1 of lighting device 30. Light beam projection R1B includes central zone R1C, left elongation zone R1L, right elongation zone R1R and peripheral zone R1P. Peripheral zone R1P is above and below central zone R1C and comprises upper peripheral zone R1UP and lower peripheral zone R1LP which combine to substantially encircle central zone R1C.

The light beam projections and zones described within this application are employed to describe characteristics of the related light beams. One skilled in the art can easily calculate the beam spread and intensity profile knowing the dimensions and illumination related to the light beam projections. The intensity variations and zones of the light beam projections are representative of the beam angle, intensity variations and zones within the light beam itself. Also, the term beam spread refers to the angular divergence of the described light beam.

Figure 14:
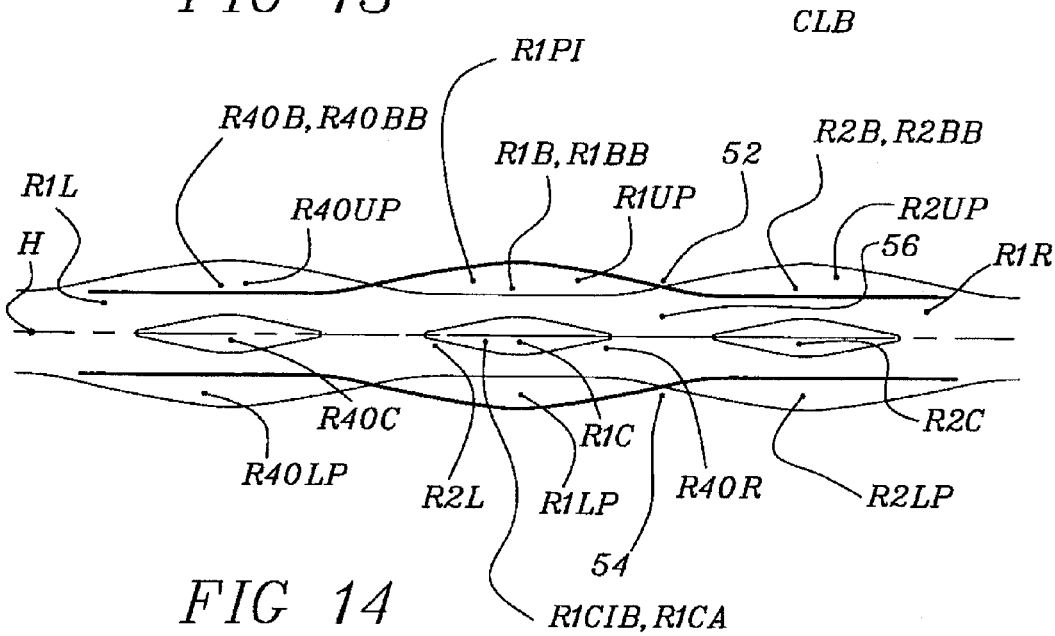

FIG. 14 is a diagrammatic view of three typical light beam projections R1B, R2B and R40B of the composite CLB of the elongated light beams R1BB, R2BB and R40BB from light emitted from three adjacent LED lamps R1, R2 and R40 of FIG. 12 respectively after their emitted light is concentrated by converging lens 1 of lighting device 30. Light beam projection R1B is shown with heavy lines to differentiate it from adjacent light beam projections R2B and R40B. This differentiation is employed to facilitate a description of the relationship among the light beam projections. In the present embodiment, all of the light beam projections from the plurality 9 of LED lamps are substantially equal. In that regard, light beam projection R2B includes central zone R2C, left elongation zone R2L, right elongation zone R2R and peripheral zone R2P. Peripheral zone R2P is above and below central zone R2C and comprises upper peripheral zone R2UP and lower peripheral zone R2LP which combine to substantially encircle central zone R2C. Similarly, light beam projection R40B includes central zone R40C, left elongation zone R40C, right elongation zone R40R and peripheral zone R40P. Peripheral zone R40P is above and below central zone R40C and comprises upper peripheral zone R40UP and lower peripheral zone R402P which combine to substantially encircle central zone R40C. Upper low intensity zone 52 and lower low intensity zone 53 are zones not receiving light from any of the projected light beams defining broad beam spread 56. LED lamps R3 through R39 have similar light beams and interacting projections.

Figure 15:
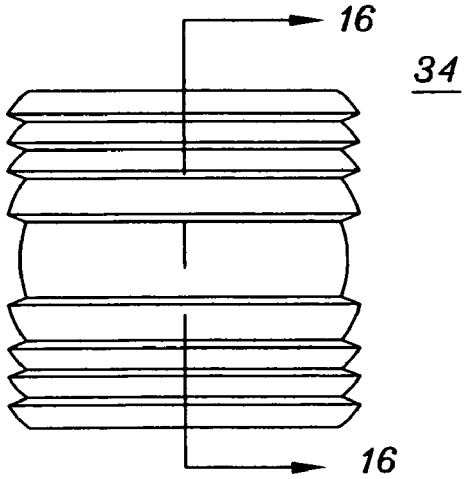
Figure 16:
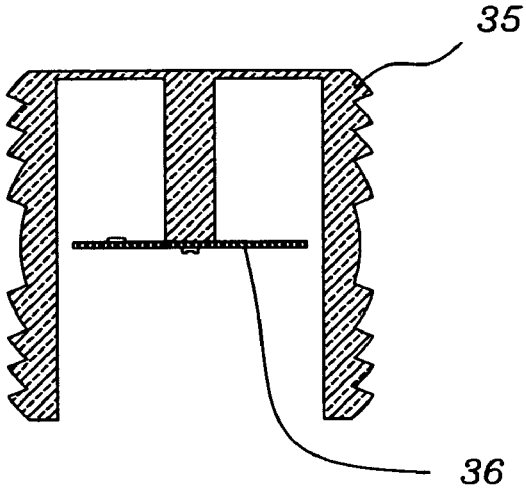

FIGS. 15 and 16 disclose lighting device 34 similar to lighting device 30 of FIG. 1. FIG. 15 is a front view of lighting device 34 and FIG. 16 is a cross sectional view of taken across line 18-18 of FIG. 15. In FIGS. 15 and 16 fresnel lens 35 is substituted for converging lens 1 of FIG. 1. Printed circuit board assembly 36 is identical to printed circuit board assembly 2. Fresnel lighting device 34 represents a classical substitution of a fresnel lens for converging lens 1 of lighting device 30.

Figure 17:
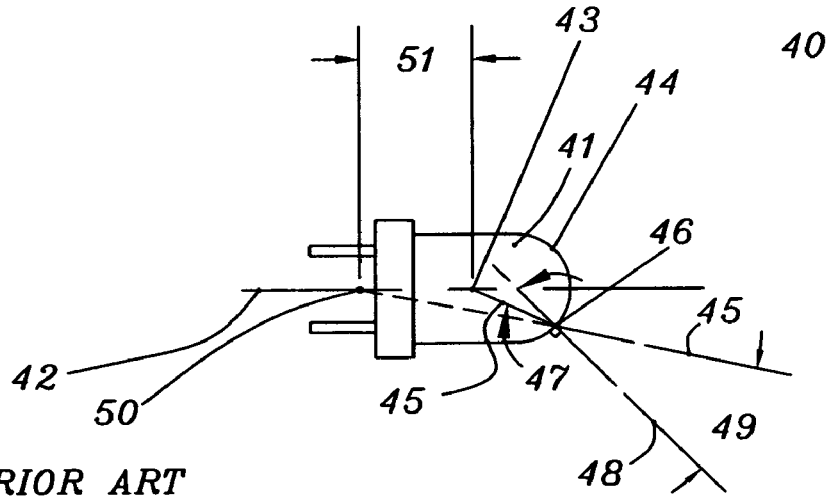
PRIOR ART FIG 17

FIG. 17 is an illustrative side view of a typical prior art T1 ¾ LED lamp 40 with a lens incorporated into its body. LED lamp 40 includes body 41, geometric body axis 42 and LED element 43. Typical light ray 45 intersects lens 44 at point of intersection 46 and forms included angle 47 with normal 48 to lens 44 at point of intersection 46. Light ray 45 is refracted to emerge from lens 44 forming included angle 49 with normal 48. Due to the refraction at lens 44 refracted light ray 45 projected back into LED lamp 40 intersects geometric body axis 42 at apparent point of emission 52 at distance 51 from LED element 43.

Operational Description of the Preferred Embodiment FIGS. 1-12

Lighting device 30 of FIGS. 1 through 14 is the preferred embodiment of the present invention. Lighting device 30 is a device in which a plurality of LED lamps emit light which is intensified and emitted through a single lens to form a broad beam elongated light beam having a minimum intensity throughout a vertical beam spread of ten degrees from minus five degrees to plus five degrees throughout a three hundred and sixty degree azimuth. There are a large number of user defined required specifications. Some require a peak intensity at the center of the beam and define a beam angle as the included angle between directions at which the intensity has decreased to an established percentage—usually 10 or 50—of the peak intensity. Other common specifications require light beams having vertical beam spreads of ten and thirteen degrees elongated to illuminate a three hundred and sixty degree azimuth. In order to comply with a particular specification, adjustments in the design parameters of the current invention such as the contour of lens 1, number of LED lamps, type of LED lamps, positioning of LED lamps, power supplied, etc would be required. These adjustments can be made by a person experienced in the art using the current application, classical concepts and trial and error.

Figure 8:
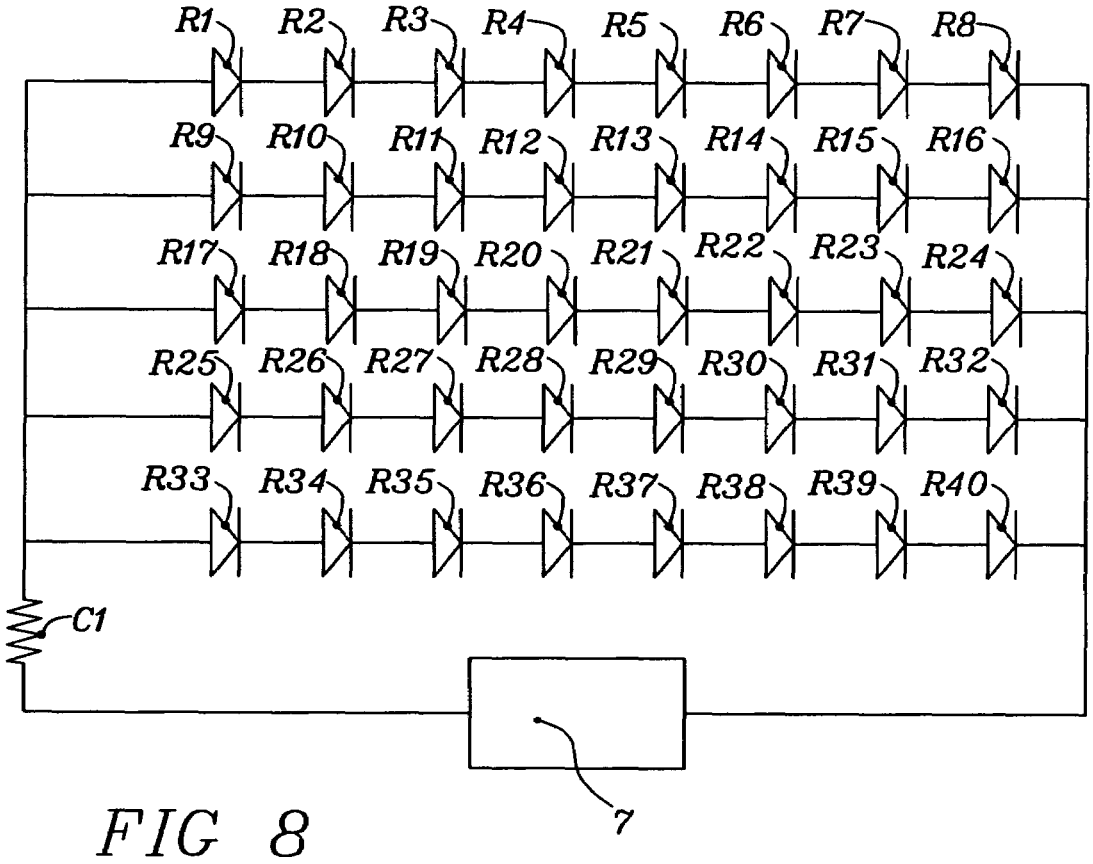

Looking at FIG. 8 schematic 16 of FIG. 8 power supply 7 is energizing plurality 9 LEDs. Power supply 7 is a battery of 28 volts DC, however, it could be any one of a variety of sources of electrical power including an external source such as a regulated direct current power supply. Resistor C1 reduces the voltage from power supply 7 such that when the remaining voltage is divided among the five parallel sets of eight LED lamps the value of the resistor is usually established by trail and error after the output beam is measured and compared with the specification requirements. LED lamps R1 thru R40 are thereby energized to the power level required for lighting device 30 to emit a light beam meeting specification intensity and beam spread requirements. There are numerous alternate classical circuit configurations which could substitute for the one shown in schematic 16 of FIG. 8. These include pulse width modulation, constant current, constant voltage, etc.

Looking at FIGS. 3, 4, 9, 10, 11 and 12 lens 1 is a converging lens shown having a typical piano convex form 29 and having a plurality of focal points defining curved focal line 26. A focal point for lighting device 30 of the current invention is defined as the point upon which a plurality of light rays approaching lens 1 from a distance parallel to the horizontal plane and coincident with a vertical or a normal refraction reference plane that is perpendicular to inner surface 27 of lens 1 converge. This is a classical definition of a focal point. However, due to the donut shape of lens 1 a plurality of focal points will be defined. The current invention is not limited to the piano convex form of a condensing lens as there are numerous alternative classical light converging lens forms which could acceptably be employed in the current invention. These alternative lenses can include a curved interior surface or a contour which defines a group of focal points for each normal refraction reference plane. In this preferred embodiment when a particular LED is energized, its widely diverging light will be directed radially outward and intersect lens 1 where—due to the converging contour of lens 1—it will be concentrated towards a vertical beam spread which although broad, comprises a divergence substantially less than the light first emitted from the LED. Since lens 1 has a horizontal curved focal circle 24 and plurality 9 LED lamps are disposed having an equiangular disposition, the light will emerge from lens 1 concentrated toward a specification broad vertical beam spread and also throughout a larger azimuth. The location and size of the vertical beam spread and the azimuth will be determined by the shape of lens 1, the disposition of plurality 9 LED lamps relative to curved focal line 26 and other parameters. The values of the parameters are developed using classical ray tracing and testing. According to the prior art references, the emerging beam will be elongated. U.S. Pat. No. 6,048,083 issued to McDermott in Column 8, Line 14 refers to the elongated beam. U.S. Pat. No. 5,899,557 issued to McDermott in Column 11, Lines 31-35 refers to a beam with a horizontal beam spread that exceeds a vertical beam spread. Since plurality 9 LED lamps are disposed in horizontal plane H encircled by lens 1 according to FIG. 3 and prior art, the emerging beam will have a first angular beam spread or beam spread in the vertical plane and a larger angular beam spread in the horizontal plane. In the preferred embodiment of lighting device 30 the azimuth or horizontal beam spread is three hundred and sixty degrees. Therefore, the emerging beam from lighting device 30 will be elongated in a direction parallel to a plane coincident with focal points 25 which in the current embodiment is horizontal plane H.

Looking now at FIG. 11, energized red LED R1 is typical of remaining red LEDs R2 through R40 of plurality 9 when they are energized. Red LED R1 is disposed with its light emitting element 15 on broad beam point 38 on horizontal plane H so that its emitted light intersects interior surface 27 of lens 1. Red LED R1 emits a variety of widely diverging light rays. Upper vertical light ray L1 and lower vertical light ray L2 are typical of those emitted in vertical plane V. Light rays L1 and L2 intersect interior surface 27 at a vertical distance D2 which is related to the size and mass of lens 1. It is noteworthy to realize that if light emitting element 15 were moved away from lens 1 to focal point F1 or to minimum divergence point 32 then back focal length D1 and vertical distance D2 would both increase thereby increasing the size and mass of lens 1 This is not desirable as larger lenses are more expensive to shape and more difficult to mold accurately.

Looking again at FIG. 11 with red LED element 15 on broad beam point 38 lens 1 is concentrating red light as required in the current application. Each of the LEDs of plurality 9 are, like red LED R1, additionally positioned with their apparent point of emission on apparent emission line 33 which in the present embodiment is between focal circle 24 and lens 1 coincident with broad beam curved line 39.

It is important to realize that for the present optical system there is a difference in construction—especially in the placement of the LED lamps—of a device as shown in prior art that concentrates the light about a plane and maximizes intensity directly in front of each LED and a device also as shown in prior art that solely maximizes the intensity about a plane. There is also a difference between either of the aforementioned prior art lighting devices and the lighting device of the current invention which maximizes the light energy directed into a specification broad vertical beam spread. The required specification will greatly influence the design of the lighting device especially the placement of the LED lamps. The overall performance of the lighting device will depend on a number of parameters which interact to create the efficiency of the emerging beam. If in FIG. 11 plurality 9 LED lamps were disposed with their apparent point of emission line 33 on focal circle 24 instead of on broad beam curved line 39 this would be the most advantageous position for prior art in which the specification required the light to be concentrated about horizontal plane H with the highest intensity in vertical plane V directly in front of each red LED typified by red LED R1. If on the other hand, the specification required the light only to be concentrated with minimal divergence about horizontal plane H, but not necessarily with the maximum intensity in vertical plane V directly in front of red LED R1, then for many configurations of lighting device 30 plurality 9 LED lamps would be—according to McDermott U.S. Pat. No. 6,048,083—disposed just slightly in front of focal circle 24 coincident with minimum divergence curved line 37 between focal circle 24 and lens 1. Finally, if the specification required the light to be concentrated within a broad vertical beam spread then plurality 9 LED lamps would as shown in FIG. 11 be placed coincident with broad beam curved line 39. This disposition between minimum divergence curved line 37 and lens 1 improves the efficiency for broad beam designs. For this LED placement of red LED R1, the emerging beam from converging lens 1 would have a light beam projection from red LED R1 R1B as shown in FIG. 13. In FIG. 13 light beam projection RIB has central zone R1C of a first intensity at least partially surrounded by a peripheral zone R1P of a second and relatively higher peripheral intensity R1P1. Peripheral zone R1P comprises lower peripheral zone R1LP and an upper peripheral zone R1UP both of which are of higher intensity than central zone R1C. Central zone R1C is a central intensity R1C1 of a depressed intensity R1CD as it is substantially surrounded by higher intensity zones. Beam projection R1B additionally has left elongation zone R1L and right elongation zone R1R both also usually brighter than central zone R1C. Beam projection R1B does comply with a specification if that specification required the beam to fall within a broad vertical beam spread that included peripheral zone R1P. It efficiently places a large percentage of the emitted light within the required broad beam spread. However, most specifications also require the intensity at the center to be at least equal to the intensity at the periphery and in that regard, FIG. 13 would not always be an acceptable beam projection. Fortunately, lighting device 30 has plurality 9 of LED lamps and the current invention employs lens 1 to efficiently concentrate the plurality of elongated light beams from plurality 9 of LED lamps to create a composite light beam which is of an acceptable peripheral and central intensity. Looking at FIG. 14, the light beam projections R1B, R2B and R40B from adjacent LED lamps R1, R2 and R40 in FIG. 5 overlap such that the low intensity or depressed central zone of each individual light beam is overlapped by the elongated zones from light beams of adjacent LED lamps. In FIG. 14 light beam projection R1B shown in heavy line weight has central zone R1C of low intensity. However, overlapping central zone R1C from the left is right elongation zone R40R from red LED R40 and overlapping from the right is left elongation zone R2L, from red LED R2. Thus, the two elongated zones of adjacent LED lamps add to the intensity of central zone R1C to increase or buttress its intensity to an acceptable level. It is possible, depending upon the design configuration of lighting device 30, for one or a quantity of nearby LED lamps to add light to the central zone of each LED lamp. This process repeats itself for the central zone of the light beam of each LED of plurality 9 of LEDs. Hence, elongated light beams from each LED lamp of plurality 9 overlap and buttress the central zone of the elongated light beams of adjacent LED lamps. Each addition of light reduces the depression in intensity of a central zone. If enough adjacent LED lamps add light to a particular central zone, its intensity can be increased such that it becomes equal to or more intense than its peripheral zone. The concepts of the current invention are still applicable even if the LED type, LED disposition and contour of lens 1 are modified using ray tracing such that the elongated light beam from each LED lamp emerges with a central zone having an intensity equal to or even greater than the intensity of its peripheral zone. Depending upon the exact parameters of the design and the specification requirements, the efficiency of this alternate embodiment may be reduced over the preferred embodiment of FIG. 1. Nevertheless, this alternate embodiment can still be a valuable option. In this alternate configuration the elongated zone of adjacent LEDs will continue to add light to the central zone but in this instance the added light will increase the central zone intensity to higher levels relative to the intensity of the peripheral zone. This is desirable for specifications which require a high or peak intensity at the center of the light beam. The present invention in using the elongation zones of one LED to add to the intensity of adjacent LED's maximizes the efficiency of lighting devices typified by lighting device 30 while still complying with a variety of specifications. Looking again at FIG. 14 upper low intensity zone 52 and lower low intensity zone 53 exist between light beam projection R1B and light beam projection R2B. These low intensity zones similarly exist between each set of elongated light beams and are the result of the elongated shape of the light beams. Low intensity zones are usually not desirable. In fact, if they cannot be reduced they can make the current broad beam design inefficient. They can be reduced using the concepts provided. In the current application it is desirable to use a short focal length because it permits additional LED lamps to be added to plurality 9 of LED lamps, thereby beneficially reducing both the angular spread between LED lamps and the size of the low intensity zones. Additionally, it beneficially increases the intensity within the low intensity zones. Shortening the focal length also changes the contour of the elongated light beam projection from each LED shown in FIG. 13 so that its azimuthal divergence is reduced, its elongation zones R1L and R1R have increased intensity, its elongation zones have a larger vertical beam spread and the shape of the light beam projection R1B moves toward a more rectangular contour. This change in shape helps increase the intensity of the low intensity zones typified by low intensity zones 52 and 54. In addition, since a short focal length also increases the vertical beam spread of elongation zones R1L and R1R it permits those zones to completely overlap the central zone of an adjacent LED. Complete overlapping of adjacent central zones avoids portions of the central zone remaining at low or depressed light levels and therefore, avoids problematic depressions in the intensity of the composite light beam. Generally, focal lengths under fifteen millimeters provide improved performance for many designs. As previously stated the shape of the emerging light beam from lighting device 30 depends upon a number of variables in addition to LED placement. Establishing acceptable characteristics for each variable can be achieved with ray tracing and prototyping. The current invention will not find application for specifications which mandate minimal divergence about the horizontal plane H or where the required vertical beam spread is under four degrees.

The ceramic LED has parameters which are very helpful in producing the broad beam lighting device disclosed in this application. The typical ceramic LED shown in FIGS. 6 and 7 as red LED R1 is substantially less popular and more expensive than the T1 or T1 ¾ LEDs disclosed in prior art and drawn in FIG. 17. The ceramic red LED R1 was designed to be surface mounted on a printed circuit board. It comprises a thin rectangular package having a size of 3.5 millimeters×3.5 millimeters×0.8 millimeters. The 0.8 millimeters represents the height from the back of the LED to the LED element. In contrast a typical T1 LED which is similar and smaller than the T1 ¾ discussed in prior art is tubular in shape with a base diameter of 3.9 millimeters and a height from the base to the LED element of about 3 millimeters. Thus, the T1 LED is 0.4 millimeters larger at the base and 2.2 millimeters higher from the base to the LED element. The size and shape of the ceramic LED permits more LEDs to be employed in a printed circuit board of a fixed size employed with a lens having a fixed focal circle. More LEDs in the array generally improve the intensity and azimuthal uniformity of the emerging light beam. The ceramic LED such as red LED R1 does not include the lens of the commonly used T1 LED and this absence of a lens avoids light from one LED being lost due to its intersecting the lens or body of an adjacent LED. The absence of a lens provides an LED in which the apparent point of light emission is coincident with light emitting element 15. Hence, there is no apparent shifting of the point of emission. The problem of apparent shifting of the point of emission was reviewed in FIG. 17 as revealed in prior art. Eliminating this problem supports the decision to reduce the focal length and gain its benefits.

The absence of a lens on ceramic LED results in an LED emitting light having a widely divergent pattern in which the total directivity to fifty percent of peak intensity is 120 degrees. This wide divergence also helps fill dark zones between LED lamps in the emerging light beam. In the present embodiment, the ceramic LEDs of plurality 9 have an equiangular disposition and are attached to peripheral edge 20 of printed circuit board 5 with their emitted light directed radially outward from center point 31 to intersect lens 1. When mounted on peripheral edge 20 the ceramic LEDs which are devoid of wire leads do not use surface space on printed circuit board 5. Also, since they do not have wire leads, surface space is not required to solder wires on printed circuit board 5. Ceramic red LED R1 can be soldered any one or all of peripheral top 19, peripheral bottom 10 or peripheral edge 20. Conductive tracks 8 extend onto peripheral edge 20 to facilitate soldering. Surface space is commonly needed for other components or conductive tracks 8 and saving surface space permits a lighting device of a reduced size. Finally, by soldering ceramic red LED R1 to peripheral edge 20, peripheral top 19 and possibly peripheral bottom 18, heat generated by red LED R1 is readily transferred away from LED element 15 by conduction at solder pads 13 and 14, by conduction into peripheral edge 20 of printed circuit board 5 and by convection as air moves freely past ceramic body 14. Other ceramic LEDs of plurality 9 employed in the preferred embodiment are similarly mounted having good heat dissipation. Thus, all of the intrinsic advantages of the surface mounted ceramic LED are realized even though it is mounted—not as designed—on the face of a printed circuit board but on peripheral edge 20 directing its emitted light radially outward to accommodate the directivity needs of the preferred embodiment.

FIGS. 15 and 16 disclose a lighting device 34 similar to lighting device 30 of FIG. 1 except fresnel lens 35 is substituted for converging lens 1. This is an alternate configuration of the preferred embodiment and will function in a similar fashion.

FIG. 17 is an illustrative side view of a typical prior art T1 ¾ LED lamp 40. Due to the refraction at lens 44 refracted emerging light ray 45 is more parallel to geometric body axis 42. Refracted lighting projected back into LED lamp 40 intersects geometric body axis 42 at apparent point of emission 52 at distance 51 from LED element 43. If refracted light ray 45 is projected back into LED lamp 40 it intersects geometric body axis 42 at apparent point of emission 50. LED lamp 40 has only one actual LED element 43 and therefore only one point of light emission. However, due to lens 44 light ray 45 appears to originate from a location separated from the location of LED element 43. Distance 51 represents the separation between the actual point of emission of light ray 45 at LED element 43 and its apparent point of emission 50. If LED lamp 40 is substituted for red LED lamp R1 in the FIG. 11 embodiment of the current invention, lens 1 will refract light emerging from LED lamp 40 as if it were emerging from apparent point of emission 50 and not from the location of LED element 43. Therefore, in that situation for lens 1 to direct the light from lamp 40 properly, lamp 40 would have to be located relative to focal point F1 of FIG. 11 based upon its apparent point of light emission 50 rather than the actual location of LED element 43. The current invention uses LED lamps such as red LED R1 which do not include integral domes, lenses or optics and therefore, have their apparent point of emission 57 at their LED element 15 as shown in FIGS. 11 and 12. Therefore, the current invention does not have to adjust the position of each LED element relative to focal point F1 to account for a separation between the actual and the apparent location of its LED element.

Although the description above contains many specificities, these should not be construed as limiting the scope of the invention but as merely providing illustrations of some of the presently preferred embodiments of this invention.

For example, in FIG. 9 interior surface 27 is a straight line. However, other acceptable light converging lenses may have a curved interior surface when in the vertical cross section of FIG. 9. In this case, the back focal length would still be defined as the distance between focal point F1 and interior surface 27.

Also, in the preferred embodiment, lens 1 has a plano convex form 29 and in FIG. 9 is shown as having back focal length D1, focal point F1 and a curved focal line 26 which is a focal circle 24. Focal point F1 is classically defined as the point in hollow 11 of FIG. 11 at which incident horizontal parallel rays from the exterior of lens 1 in vertical plane V converge. Each additional cross section similar to FIG. 11 in a different vertical plane through a different LED and perpendicular to interior surface 27 will define an additional focal point similar to focal point F1. Curved focal line 26 is the locus of these focal points. Curved focal line 26 is a focal circle 24 in the preferred embodiment because lighting device 30 is designed to concentrate the light into a light beam having a required vertical beam spread throughout an azimuth of three hundred sixty degrees. There are specifications which only require the emerging light beam to extend throughout a limited azimuth such as one hundred eighty degrees. For these specifications, curved focal line 26 need not form a circle. In that design it would have a reduced azimuth related to the required azimuth of the specification.

Furthermore, in general the term broad beam spread within the present application can nominally be considered as any beam spread exceeding four degrees. However, for a specific light with an established converging lens and an established plurality of LED lamps prior art disposes of the apparent points of emission of the plurality of LED lamps at the focal line or a slight distance from the focal line between the focal line and the lens. Either of the prior art dispositions will substantially minimize the divergence of light about the horizontal plane. The current application disposes the apparent points of emission of its LED lamps at broad beam curved line 39 between the disposition of the McDermott LED lamps on the minimum divergence curved line 37 and the lens. (See McDermott U.S. Pat. No. 6,048,083 Column 5, Lines 22-25). This current disposition creates a vertical beam spread that exceeds the minimum divergence about the horizontal objective of prior art for that specific light. Therefore, for a specific light in the current application any beam spread that exceeds the minimum divergence or beam spread is to be considered a broad beam spread for that specific light. In many cases, this broad beam is a beam spread that exceeds four degrees.

Also, an LED lamp within the present application is not meant to be restricted to the LED lamp disclosed in the preferred embodiment. Any lamp comprising an LED element which meets the objectives of the current application can be employed.

Finally, the present invention was created by fabricating and testing a variety of configurations of lighting devices. Adjustments to the intensity and contour of the emerging beam can be made using the concepts disclosed herein in combination with classical ray tracing and prototyping Thus, the scope of the invention should be determined by the appended claims and their legal equivalents, rather than by the examples given.

I claim:

1. A lighting device comprising:

a converging lens having a curved contour, a hollow and a plurality of focal points on a curved line;

a light source comprising a plurality of LED lamps each positioned within said hollow about said curved line to direct emitted light outward to intersect said converging lens; and said plurality of LED lamps each emitting a light concentrated by said converging lens to form an elongated light beam, said elongated light beam having a peripheral zone comprising a peripheral intensity around a central zone comprising a central intensity less than said peripheral intensity, each said elongated light beam overlapping an adjacent central zone of at least one adjacent LED lamp.

2. A lighting device comprising:

a converging lens having a curved contour, a hollow and a plurality of focal points on a curved line and on a horizontal plane;

a light source comprising a plurality of LED lamps each positioned within said hollow about said curved line to direct emitted light outward to intersect said converging lens; and said plurality of LED lamps each emitting a light concentrated by said converging lens to form an elongated light beam, said elongated light beam elongated parallel to said horizontal plane and having a vertical beam spread comprising a central zone of a depressed intensity, each said elongated light beam extending into an adjacent central zone of the elongated light beam of at least one adjacent LED.

3. A lighting device comprising:

a converging lens having a curved line and a minimum divergence curved line within a hollow; and a light source comprising a plurality of LED lamps each positioned within said hollow about said curved line to direct emitted light outward to intersect said converging lens, said plurality of LED lamps each emitting a light having an apparent point of emission disposed between said minimum divergence curved line and said lens, said light concentrated by said converging lens to form an elongated light beam elongated in a direction parallel to a first plane coincident with said curved line.

4. A lighting device comprising:

a converging lens having a curved line and a minimum divergence curved line within a hollow;

a light source comprising a plurality of LED lamps each having an apparent point of emission positioned within said hollow between said minimum divergence curved line and said lens to direct emitted light outward to intersect and to be concentrated by said converging lens to form an elongated light beam having a central zone; and said central zone overlapped by the elongated light beam of at least one adjacent LED.

5. A lighting device comprising:

a converging lens having a curved line within a hollow; and a light source comprising a plurality of LED lamps each positioned within said hollow about said curved line to direct emitted light outward to intersect said converging lens, said plurality of LED lamps each emitting a light having an apparent point of emission disposed between said curved line and said lens, and light concentrated by said converging lens to form an elongated light beam, said elongated light beam elongated in a direction parallel to a first plane coincident with said curved line and comprising a broad beam spread in a second plane perpendicular to said first plane.

6. A lighting device comprising:

a converging lens having a curved line within a hollow;

a light source comprising a plurality of LED lamps each having an apparent point of emission positioned within said hollow between said curved line and said lens to direct emitted light outward to intersect and to be concentrated by said converging lens to form an elongated light beam having a broad beam spread and a central zone; and said central zone overlapped by a light from an elongation zone of at least one adjacent LED.

7. A lighting device according to claim 1, 2, 3, 4, 5 or 6 wherein;

said plurality of LED lamps are disposed having a substantially equiangular spacing.

8. A lighting device according to claim 1, 2, 3, 4, 5 or 6 wherein;

said converging lens comprises a common zone concentrating the light of at least two of said plurality of LED lamps.

9. A lighting device according to claim 1, 2, 3, 4, 5 or 6 wherein;

said plurality of LED lamps are disposed in a radial array about a center point of said converging lens.

10. A lighting device according to claim 1, 2, 3, 4, 5 or 6 wherein;

said converging lens further comprises a plane convex cross section.

11. A lighting device according to claim 1, 2, 3, 4, 5 or 6 wherein;

said converging lens is a cylindrical Fresnel lens.

12. A lighting device according to claim 1, 2, 3, 4 or 6 wherein;

said curved line is substantially circular.

13. A lighting device according to claim 1, 2, 3, 4, 5 or 6 wherein;

said plurality of LED lamps each have a ceramic body.

14. A lighting device according to claim 1, 2, 3, 4, 5 or 6 wherein;

said plurality of LED lamps each have a ceramic body disposed on a peripheral edge of a printed circuit board connected to said converging lens.

15. A light device according to claim 1, 2, 3, 4, 5 or 6 wherein;

said plurality of LED lamps each have a ceramic body devoid of a lens;

said curved line is a focal line; and said converging lens comprises an interior surface disposed less than fifteen millimeters from said curved line.

16. A lighting device according to claim 1, 2, 3, 4, 5 or 6 wherein;

said curved line is a focal line; and said converging lens comprises an interior surface disposed less than fifteen millimeters from said curved line.

17. A lighting device according to claim 1, 2, 3, 4, 5 or 6 wherein;

said curved line is a focal line.

18. A lighting device according to claim 1, 2, 3, 4 5 or 6 wherein;

the elongated light beams from said plurality of LEDs overlap throughout a three hundred and sixty degree azimuth.

19. A lighting device according to claim 1, 2, 3, 4, 5 or 6 wherein;

the elongated light beam from said plurality of LED lamps are further concentrated by said converging lens into a composite light beam having a specification broad vertical beam spread exceeding four degrees throughout a three hundred and sixty degree azimuth.

20. A lighting device according to claim 1, 2, 3, 4, 5 or 6 wherein;

said curved line is coincident with a horizontal plane; and the elongated light beams from said plurality of LED lamps are further concentrated by said converging lens into a composite light beam having a specification broad vertical beam spread exceeding four degrees throughout a three hundred and sixty degree azimuth.

21. A lighting device according to claim 1, 2, 3, 4, 5 or 6 wherein;

the elongated light beams from said plurality of LED lamps overlap to form a composite light beam having a central zone of peak intensity.

22. A lighting device according to claim 1, 2, 4 or 6 wherein;

the elongated light beams from said plurality of LED lamps are each elongated in a direction parallel to a plane coincident with said curved line.

23. A lighting device according to claim 1, 2, 5 or 6 wherein;

Said plurality of LED lamps each have an apparent point of emission disposed on a virtual emission line located between a minimum divergence curved line of said lens and said lens.

24. A lighting device according to claim 1, 3, or 5 wherein;

the elongated light beams each have a central zone of a depressed intensity.

25. A lighting device comprising:

a converging lens having a curved line on a horizontal plane within a hollow;

a light source comprising a plurality of LED lamps each positioned within said hollow about said curved line to direct emitted light radially outward to intersect said converging lens;

said plurality of LED lamps each have a ceramic body disposed on a peripheral edge of a printed circuit board connected to said converging lens;

said plurality of Led lamps each emitting a light concentrated by said converging lens to form a light beam elongated in a direction parallel to said horizontal plane, said elongated light beam comprising a vertical beam spread comprising a central zone and an elongation zone extending into an adjacent central zone of at least one adjacent LED; and the elongated light beams overlapping to form a composite elongated light beam having a broad vertical beam spread throughout a three hundred and sixty degree azimuth.

* * * * *